United States Patent [19]

Cavazza

[11] Patent Number: 4,574,562

[45] Date of Patent: Mar. 11, 1986

[54] RECIPROCATING FOLDER FOR PACKAGING MACHINES

[75] Inventor: Roberto Cavazza, Bologna, Italy

[73] Assignee: SASIB S.p.A., Bologna, Italy

[21] Appl. No.: 729,899

[22] Filed: May 2, 1985

[30] Foreign Application Priority Data

May 3, 1984 [IT] Italy ..... 12505 A/84

[51] Int. Cl.[4] ..... B65B 49/08; B65B 49/16

[52] U.S. Cl. ..... 53/381 R; 53/226; 53/228; 53/234

[58] Field of Search ..... 53/226, 228, 234, 381 R, 53/466, 387, 374, 376

[56] References Cited

U.S. PATENT DOCUMENTS 2,081,626 5/1937 Hayward ..... 53/228
2,949,001 8/1960 Zwarycz .
3,468,097 9/1969 Mack .
3,619,977 11/1971 Theys et al. .
3,808,767 5/1974 Reid ..... 53/375
4,483,125 11/1984 Suga ..... 53/450

*Primary Examiner*—John Sipos
*Assistant Examiner*—Donald R. Studebaker
*Attorney, Agent, or Firm*—Spencer & Frank

[57] ABSTRACT

The invention relates to the reciprocating folders (6) used in packaging machines, packing machines and the like, particularly in cellophane wrapping machines, for folding on one side (103) of an article (3) to be packaged an edge (104) of a sheet (4) or slip of wrapping material, particularly of a material which is not much rigid and/or is easily charged with static electricity. According to the invention, for preventing the folder (6) from dragging along, during its return stroke, the folded edge (104) of the sheet (4) or slip, one or more blowing nozzles (9,109) are provided, and are oriented and arranged in such a manner that an air layer is generated between the folder (6) and the folded edge (104) of the sheet (4) or slip.

10 Claims, 4 Drawing Figures

RECIPROCATING FOLDER FOR PACKAGING MACHINES

BACKGROUND AND SUMMARY OF THE INVENTION

This invention relates to the reciprocating folders used in packaging machines for folding an edge of a sheet or slip of wrapping material on one side fo an article to be packaged, and that consist of a blade, a fin, or the like, which is substantially flat and is movable parallelly and close to the article side on which the edge of the sheet or slip must be folded.

In the reciprocating folders of this kind, the edge of the wrapping sheet or slip is folded on the article to be packaged by means of the so-called forward or outward stroke of the reciprocating folder, after which the folder performs its return stroke into starting position, while the folded edge must remain in folded position on the respective side of the article to be packaged. However, during the return stroke of the folder, the folded edge is apt to be dragged along by the folder and to be retracted therewith owing to friction and/or the attraction due to statical electricity, the more so when the wrapping sheet or slip is of flabby material, i.e., not much rigid and/or easily chargeable with statical electricity, such as plastic material, particularly polyethylene.

The invention aims to eliminate the said drawback and, to this end, it provides one or more blowing nozzles which are so arranged and oriented that an air layer is generated between the folder and the folded edge of the sheet or slip, during the return stroke of said folder. Preferably, the blowing nozzle or nozzles are so oriented that their air jets are directed in opposite direction to the return stroke of the reciprocating folder.

The blowing nozzle or nozzles according to the invention can be located and arranged in any suitable manner. According to one embodiment of the invention, the blowing nozzle or nozzles can be provided in a fixed nozzle-carrying member which is substantially parallel to the folder and is located substantially on the ideal prolongation of that side of the article to be packaged on which the edge of the sheet is folded by the folder. According to another embodiment of the invention, the blowing nozzle or nozzles can be provided in the reciprocating folder itself.

The blowing nozzle or nozzles according to the invention can be intermittently activated, each time at the starting of, or shortly before the return stroke of the folder, or they can be continuously operated, especially when their jets are directed in the opposite direction to the return stroke of the folder.

In any case, the air layer which according to the invention is generated by means of the blowing nozzle or nozzles between the folder and the edge of the sheet folded on the article to be packaged, prevents this edge from being dragged along by the folder owing to friction and/or statical electricity, during the return stroke of the folder. At the same time, the air jets generated by the blowing nozzle or nozzles keep the folded edge tightly adherent to the respective side of the article to be packaged.

BRIEF DESCRIPTION OF THE DRAWINGS

The above and other features of the invention and the advantages arising therefrom will appear in the following specification of two embodiments which are shown in the annexed drawings, in which.

DESCRIPTION OF THE PREFERRED EMBODIMENTS

Figure 2:
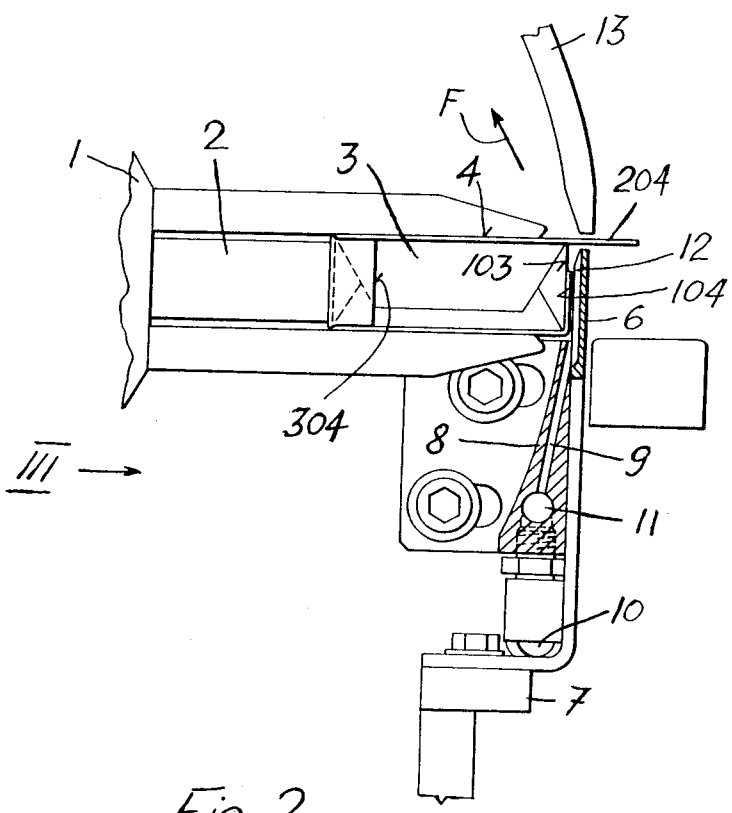
FIGS. 1 and 2 show in elevation and sectioned in part on line I—I of FIG. 3, a reciprocating folder according to the invention, in two different operative positions.

In the figures, reference numeral 1 indicates the star-shaped wheel of a cigarette pack cellophane wrapping machine of known type. This star-shaped wheel has cells 2 in its periphery, which are designed for accomodating each a cigarette pack 3 around which a slip 4 of cellophane or of a like material, such as polyethylene, is U-wrapped. One of the sides 103 of pack 3 and the respective two free edges 104 and 204 of the U-bent slip 4 peripherally protrude from cell 2. In the sides of cell 2 there are provided two known tongues 5 which, upon insertion of pack 3 together with slip 4 into cell 2, form on the head ends of pack 3 the folds 304 in the edges of the U-bent slip 4.

Figure 1:
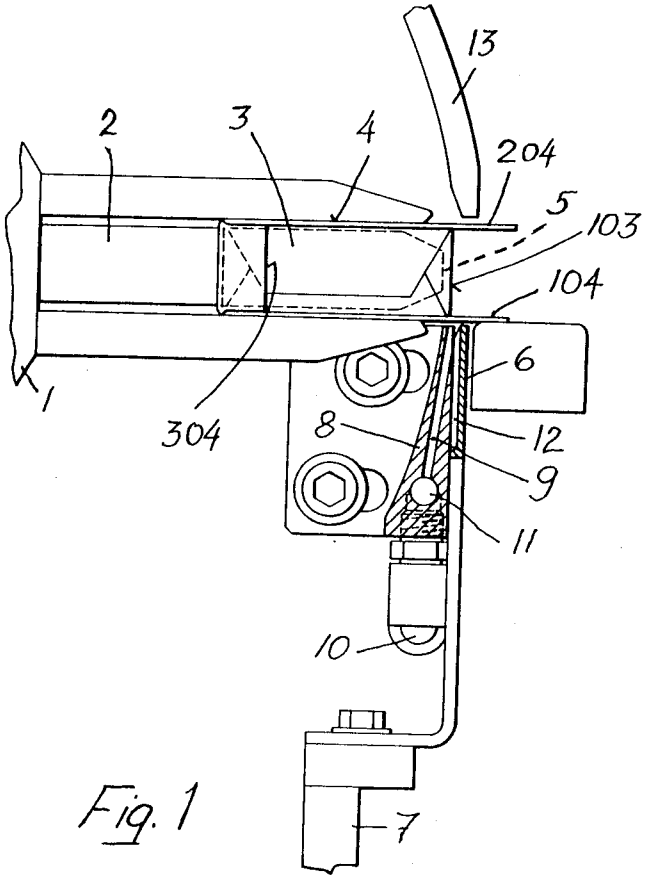

The star-shaped wheel 1 is intermittently operated, and while the cell 2 is dwelling in the folding station shown in FIGS. 1 and 2, the protruding edge 104 of slip 4 is folded on the corresponding side 103 of pack 3 by the action of a reciprocating folder 6. This folder 6 consists of a flat blade or fin which is substantially parallel to the said protruding side 103 of pack 3, and which is fastened to a movable support 7. By means of this support 7 the folder 6 can be moved parallel to its plane and to the side 103 of pack 3, from a retracted position shown in FIG. 1 into a forward folding position shown in FIG. 2, and vice-versa. While moving from the retracted rest position according to FIG. 1, to the forward folding position according to FIG. 2, the folder 6 engages the edge 104 of slip 4 and folds it on the respective side 103 of pack 3 by skimming over the said side 103 of pack 3, as it appears evident in the drawing. The folder 6 then performs its return stroke from the forward folding position of FIG. 2 into the retracted rest position of FIG. 1.

Figure 3:
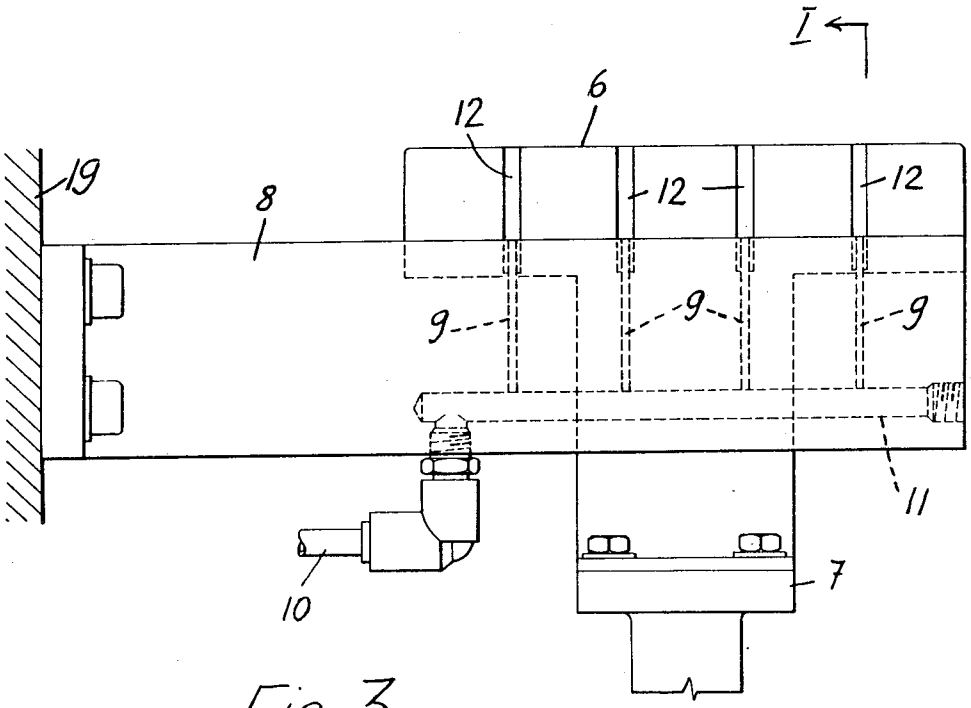
FIG. 3 is a view in the direction of arrow III of FIG. 2, showing only the nozzle carrier and the folder in forward position.

To prevent the folder 6 on its return stroke from dragging along, as a result of friction and/or statical electricity, the already folded edge 104 of slip 4, an air layer is interposed between this folded edge 104 and the folder 6. To this purpose, according to the embodiment of FIGS. 1 to 3, in the folding station a stationary bar 8 is provided opposite to the retracted folder 6 in rest position, and into or almost into contact with the folder 6 itself, and is over-hangingly secured to a fixed part 9 of the frame of the cellophane wrapping machine, and extends nearly to the protruding side 103 of pack 3 in the folding station. Provided in this bar 8 there are blowing nozzles 9 that extend substantially parallel to the folder 6 or preferably are slightly inclined towards the plane of said folder 6, and that open into the edge of bar 8 which is turned toward pack 3, in a direction substantially close to the side 103 of pack 3, on which the edge 104 of slip 4 has to be folded, and into the side of the bar 8 facing the folder 6, as it appears particularly in FIGS. 1 and 2. These blowing nozzles 9 are connected through pipe 10 and a manifold duct 11 formed in bar 8, to a compressed air source. At the outlet of each blowing nozzle 9, a groove 12 is provided in the face of folder 6 which is turned toward pack 3, and extends parallel to the direction of movement of folder 6 so as to open into the folder free end which in the retracted starting position according to FIG. 1, is turned toward the edge 104 to be folded of slip 4. The grooves 12 are of such a length that they always communicate with the outlets of the respective blowing nozzles 9, that is, throughout the forward and return stroke of folder 6.

At the starting of, or shortly before the return stroke of folder 6, the blowing nozzles 9 are activated, that is to say, they are supplied with compressed air which flows out of their outlets and into the respective grooves 12 of folder 6, and is discharged from these grooves 12 at the free edge of folder 6. This air however flows out of the grooves 12 in folder 6 also transversely to the grooves, throughout their length, thus forming an air layer between the blade or fin of folder 6 and the edge 104 of slip 4, folded on the side 103 of pack 3. At the end of the return stroke of folder 6, the feeding of compressed air to the blowing nozzles 9 can be discontinued, and can be resumed at the starting of, or shortly before the subsequent return stroke of folder 6. This intermittent operation of the blowing nozzles 9 is not always required, and the compressed air can be supplied also continuously to the blowing nozzles 9.

As it is particularly apparent in FIGS. 1 and 2, the nozzle-carrying bar 8 is wedge-shaped in cross section, which permits to same to extend as near as possible to the side 103 of pack 3 on which the edge 104 of slip 4 has to be folded, without hampering the rotation of the star-shaped wheel 1. After the above-described folding of the edge 104 on the side 103 of the pack, the star-shaped wheel is angularly moved of one step in the direction of arrow F in FIG. 2, and during this movement a stationary folder 13 folds the other protruding edge 204 of the U-bent slip 4 on the respective side 103 of pack 3 and on the edge 104 having been previously folded on the said side 103.

Figure 4:
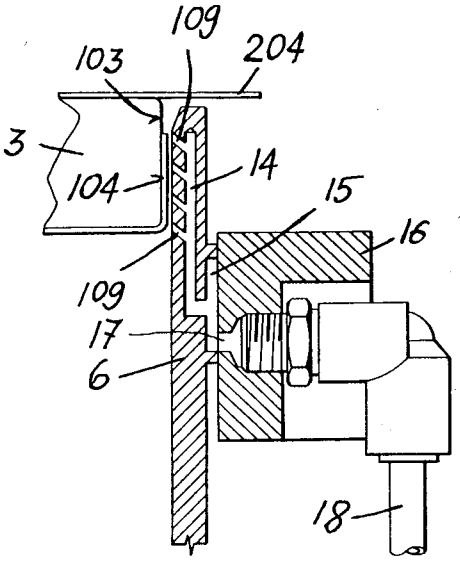
FIG. 4 is a sectional view showing a modified embodiment of the folder according to the invention.

In the modified embodiment according to FIG. 4, the blowing nozzles 109 instead of being provided in a fixed bar 8, are incorporated in the reciprocating folder 6 itself and open on the face of said folder which is turned toward pack 3. These blowing nozzles 109 are so inclined relatively to the plane of the blade or fin constituting the folder 6, that the air jets produced thereby are directed in the opposite direction to the movement of folder 6 during its return stroke. Preferably, the blowing nozzles 109 are aligned in more rows parallel to the direction of movement of folder 6 and are arranged along the width of the folder. The blowing nozzles 109 of each row are connected to a respective manifold duct 14 formed in the body of folder 6. The several manifolds 14 communicate with a recess 15 in the outer face of folder 6, which lies opposite to pack 3. By said outer face the folder 6 slides in airtight manner on a fixed block 16. On the side of said block 16, facing toward folder 6, a duct 17 opens in correspondence of recess 15, which duct 17 is connected through pipe 18 to a compressed air source. The recess 15 in the outer face of folder 6 has an extension in the direction of movement of folder 6, such that it is always in communication with the outlet of duct 17 in the fixed block 16 and therefore with the compressed air source, thus guaranteeing the air outflow from nozzles 109 and consequently the formation of the air layer between the folded edge 104 and folder 6 at least during the return stroke thereof.

Of course the invention is not limited to the described embodiments, but can be widely modified, and can be also applied to any other packaging machines and packing machines, and to other types of reciprocating folders, for example to swingable folders, that is, the folders performing an angular movement, without departing from the leading principle as set forth above and as claimed hereinafter.

I claim:

1. A reciprocating folder for use in packaging machines, for folding, on one side (103) of an article (3) to be packaged, an edge (104) of a sheet (4) or slip of wrapping material, consisting of a substantially flat blade (6) or fin folder, which is movable parallel and close to the article side onto which the edge (104) of the sheet (4) or slip is to be folded, means for moving said folder (6) from a starting position in a forward stroke by which it folds the edge (104) of the sheet (4) or slip on said side (103) of the article (3), and for moving said folder in a return stroke back to said starting position, characterized by one or more blowing nozzles (9,109) having outlets positioned between said folder and said side of the article to generate an air layer between the folder (6) and the folded edge (104) of the sheet (4) or slip during the return stroke of said folder.

2. The reciprocating folder according to claim 1, characterized in that the blowing nozzle or nozzles (9, 109) are inclined relatively to the folder plane such that their air jets are directed in the direction opposite to the return stroke of said folder (6).

3. The reciprocating folder according to claim 2, characterized in that the blowing nozzle or nozzles (9) are provided in a stationary nozzle-carrying member (8) arranged beside the plane of movement of the folder and extending as close as possible to the article side (103) on which the edge (104) of the sheet (4) or slip is folded.

4. The reciprocating folder according to claim 3, characterized in that the blowing nozzles (9) provided in the nozzle-carrying member (8) are arranged along the width of the folder (6), said outlets opening on the side of the nozzle-carrying member facing said folder (6).

5. The reciprocating folder according to claim 3, characterized in that at the outlet of each blowing nozzle (9) a groove (12) is provided in the folder face turned toward the folded edge (104), which groove (12) extends in the direction of the folder movement, and is of such a length that it is always in communication with the outlet of the associated blowing nozzle (9).

6. The reciprocating folder according to claim 5, characterized in that the grooves (12) provided in the folder (6) open into a free edge of said folder.

7. The reciprocating folder according to claim 1, characterized in that the blowing nozzle or nozzles (109) are provided in the reciprocating folder (6) and open on the folder face turned toward the folded edge (104).

8. The reciprocating folder according to claim 7, characterized in that the blowing nozzle or nozzles (109) provided in the folder (6) communicate with a recess (15) which is provided in the folder face lying opposite to the folded edge (104), and communicates with a compressed-air feed orifice (17) provided in the facing surface of a stationary member (16) against which the folder (6) tightly adheres.

9. The reciprocating folder according to claim 1, characterized by means for intermittently activating the blowing nozzle or nozzles (9,109), each time at the beginning of, or shortly before the return stroke of the folder (6), and substantially during the whole of said stroke.

10. The reciprocating folder according to claim 1, characterized in that the blowing nozzle or nozzles (9, 109) are continuously operated, both during the forward stroke and the return stroke of the folder (6).

* * * * *